United States Patent [19]

Ogles

[11] 4,099,447

[45] Jul. 11, 1978

[54] HYDRAULICALLY OPERATED OIL WELL PUMP JACK

[75] Inventor: Ethridge F. Ogles, Ada, Okla.

[73] Assignee: Ada Pumps, Inc., Ada, Okla.

[21] Appl. No.: 724,529

[22] Filed: Sep. 20, 1976

[51] Int. Cl.[2] ..... F01L 15/00

[52] U.S. Cl. ..... 91/218; 91/303; 60/369; 60/372; 60/383; 74/590

[58] Field of Search ..... 60/369, 371, 372, 376, 60/377, 383; 74/590; 91/218, 277, 281, 286, 303, 304, 338

[56] References Cited

U.S. PATENT DOCUMENTS

| | | | |
|---|---|---|---|
| 2,131,910 | 10/1938 | Vernon et al. | 91/338 |
| 2,232,449 | 2/1941 | Habenicht | 60/369 X |
| 2,550,723 | 5/1951 | Ross | 60/369 X |
| 2,704,998 | 3/1955 | Day et al. | 60/369 X |
| 3,175,513 | 3/1965 | Dulaney | 74/590 X |
| 3,369,490 | 2/1968 | Hawk | 60/372 X |

*Primary Examiner*—Edgar W. Geoghegan
*Attorney, Agent, or Firm*—Clarence A. O'Brien; Harvey B. Jacobson

[57] ABSTRACT

A hydraulically operated oil well pump jack utilizing a double acting hydraulically operated piston and cylinder assembly for pivoting the walking beam of an oil well pump jack, a linkage mechanism for operating a reversing valve to cause extension and retraction of the piston and cylinder assembly for oscillating the beam about a saddle bearing at the upper end of a stanchion or samson post together with a crossover cushioning device for controlling acceleration and deceleration of the oscillating walking beam to reduce abrupt tension forces exerted on the polish rod and sucker rods and also reduce impact forces on the oil well pump jack during oscillation of the walking beam. The oil well pump jack is adapted for use in removing or installing the polish rod, sucker rods, pump and production tubing by utilizing a gin pole assembly which includes a pair of lift cables alternately used for lifting or lowering the components with ratchet winches being provided for alternately taking up slack cable or paying out cable when slack with the walking beam including a pulley engaging each of the cables to effectively lengthen and shorten the length of the cables during oscillation of the walking beam.

12 Claims, 5 Drawing Figures

HYDRAULICALLY OPERATED OIL WELL PUMP JACK

BACKGROUND OF THE INVENTION

1. Field of the Invention

The present invention generally relates to a pump jack and more particularly a hydraulically operated pump jack for oil wells, and the like, for more effectively pumping oil by utilizing a relatively small horse power prime mover, a hydraulic pump with reversing valve and cushioning means associated with the hydraulic pump and hydraulically operated piston and cylinder assembly for controlling the pivotal movement of the walking beam in a manner to prolong the life expectancy of the components and pump a predetermined capacity of oil at a lower operating and maintenance cost.

2. Description of the Prior Art

Oil well pump jacks have been in use for many years and usually include a pivotal walking beam supported from a stanchion or samson post by a saddle bearing with the end of the beam overlying the oil well having a horsehead thereon to which a wire rope or cable bail assembly is connected for securing the beam to the upper end of a polish rod for reciprocating the polish rod, sucker rods and downhold pump. The walking beam is driven by pitman rods or arms which in turn are connected to eccentric cranks on a crank shaft with counterbalance devices being associated with the mechanism. While such devices have performed, they are relatively expensive and heavy in weight due to the large reduction gear unit and counterbalance unit normally employed. Previously known devices of this type require substantial maintenance time in order to retain the components in properly adjusted position and proper operating condition. Also, in view of the mechanical nature of the known pump jacks, substantial forces are exerted on the components of the pump jack as well as the components of the oil well pump itself which has resulted in excessive wear and fatigue breakage of various components. Efforts have been made to utilize fluid pressure operating mechanisms for pump jacks. Ross U.S. Pat. Nos. 3,221,568 and 3,405,605 and Kelley U.S. Pat. No. 3,971,213 illustrate efforts to utilize hydraulic piston and cylinder assemblies and pneumatic piston and cylinder assemblies for operating the pump jack.

SUMMARY OF THE INVENTION

An object of the present invention is to provide a pump jack for oil wells or other fluid producing wells utilizing a reciprocating pump actuated by a pivotal walking beam connected with the reciprocating pump with the walking beam being pivoted or oscillated by a hydraulic piston and cylinder assembly.

Another object of the invention is to provide a hydraulically operated pump jack including a pump and prime mover with the pump supplying hydraulic fluid pressure to the piston and cylinder assembly through a reversing valve automatically controlled by an adjustable linkage mechanism connecting the reversing valve and the pivotal walking beam.

Still another object of the invention is to provide a hydraulically operated pump jack in accordance with the preceding objects in which the hydraulic pressure system includes a crossover cushioning arrangement in which a portion of the initial high pressure fluid introduced into the piston and cylinder assembly will move into a cushioning cylinder for moving a cushioning piston for reducing initial acceleration of the piston in the piston and cylinder assembly operating the beam, thus reducing initial acceleration of the beam with this cushioning fluid pressure being subsequently reintroduced for increasing acceleration of the beam after a lower initial acceleration with the crossover cushioning being operative at both extreme positions of the beam.

Another feature of the present invention is the provision of a hydraulically operated pump jack in accordance with the preceding objects in which the pivotal walking beam is provided with a movable counterweight assembly thereon which can be adjusted to a desired position and the point of connection between the piston and cylinder assembly and the walking beam can be adjusted, thus enabling variation in the stroke of the pump without varying the stroke of the piston and cylinder assembly for powering the beam.

Still another feature of the invention is to provide a pump jack in accordance with the preceding objects in which the reversing valve operating mechanism is in the form of an over center mechanism to "snap" the reversing valve to its two extreme positions as soon as an over center position has been reached, thereby assuring rapid and positive reversal of hydraulic fluid pressure to the piston and cylinder assembly.

Yet another feature of this invention is the provision of a gin pole assembly associated with the pump jack to enable the pump jack to be effectively used when pulling a polish rod, sucker rods, downhole pump, production or tubing, or the like, from the well or when installing such equipment in the wall.

Another significant advantage derived from this invention resides in the construction of a pump jack of substantially less weight and substantially less in initial cost and with substantially less maintenance in view of the elimination of the usually provided large prime mover, reduction gear unit, crank shaft with counterbalance, pitman rods, and the like, thereby increasing the over-all efficiency of pumping oil from a producing well.

These together with other objects and advantages which will become subsequently apparent reside in the details of construction and operations as more fully hereinafter described and claimed, reference being had to the accompanying drawings forming a part hereof, wherein like numerals refer to like parts throughout.

DESCRIPTION OF THE PREFERRED EMBODIMENT

Figure 1:
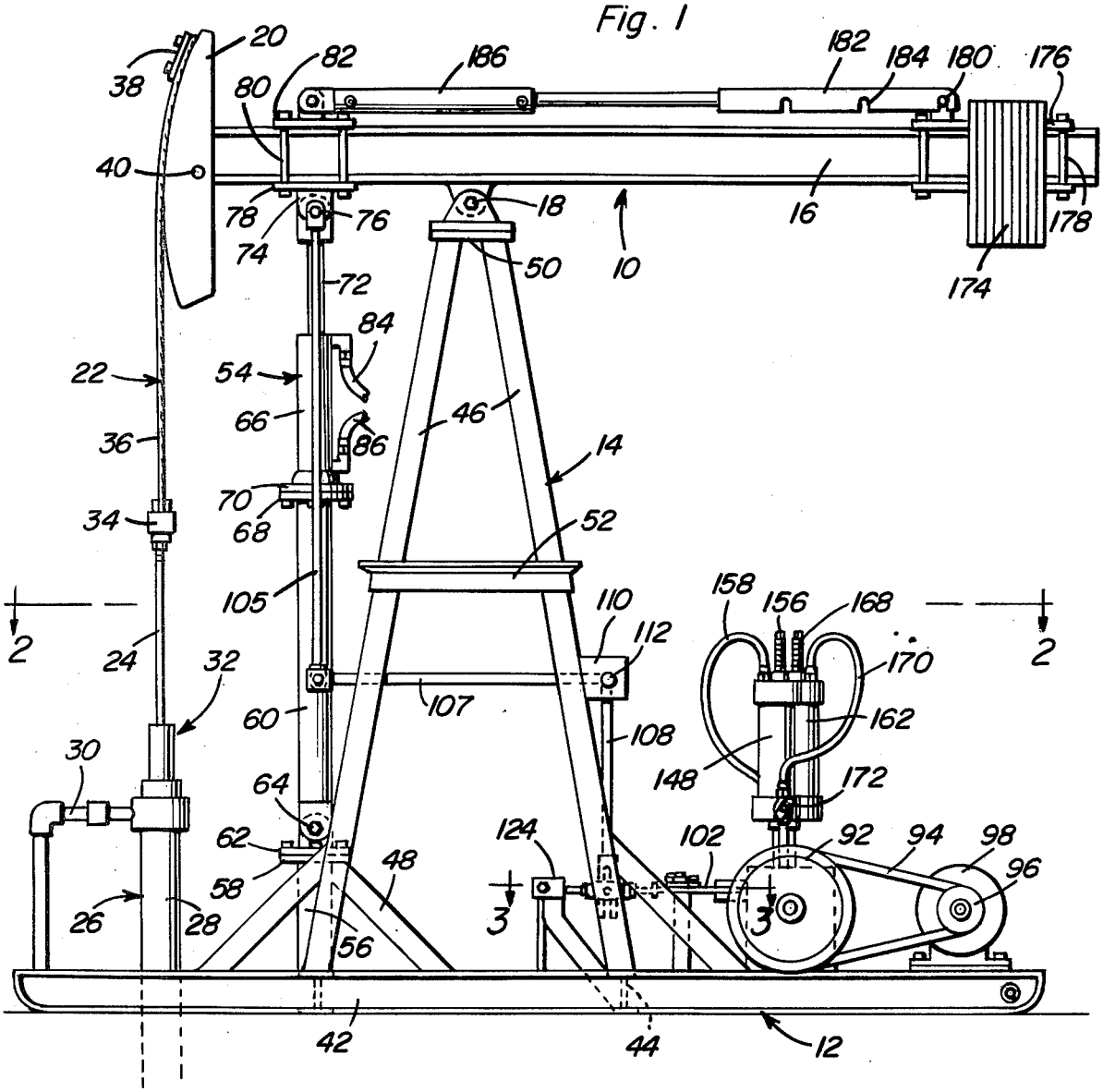
FIG. 1 is a side elevational view of the hydraulically operated oil well pump jack of the present invention illustrating the association of components.

The pump jack of the present invention is generally designated by the numeral 10 and includes a supporting base or skid 12 to which is connected a rigid upstanding stanchion or samson post 14 supporting a walking beam 16 at its upper end by the use of a saddle bearing or center bearing assembly 18. One end of the walking beam 16 is provided with a horsehead 20 to which is attached a wire rope bail assembly or bridle 22 that is connected with a polish rod 24 extending into an oil well or other production well 26 in a conventional manner which has been schematically illustrated with the well 26 including a casing 28 having a production pipeline 30 connected thereto and a stuffing box assembly 32 on the upper end thereof which receives the polish rod 24 in a conventional manner. A carrier bar and polish rod clamp assembly 34 connects the cables 36 of the wire rope or bail assembly or bridle 22 with the polish rod 24 in a conventional manner and a wire rope or bail hanger 38 connects the cable 36 to the upper end of the horesehead 20 in a well known manner. The structure of the horsehead and its relationship to the oil well including the polish rod, sucker rods attached to the polish rod and the downhole pump, production tubing, and the like, are all conventional with the horesehead being attached and detachably secured to the walking beam 16 by suitable means such as a bolt arrangement 40.

The base or skid 12 may conveniently be longitudinal structural members, such as I-beams, or the like, 42 rigidly interconnected by transverse members 44 welded thereto, or the like, and the stanchion or samson post 14 may conveniently be in the form of upwardly converging angle iron members 46 rigidly fixed to the base at the lower end thereof and braced by brace members 48 and interconnected at their upper ends by a supporting plate 50 for the saddle bearing assembly 18. A center brace assembly 52 may be provided for the upwardly converging angle iron members 46 thus providing a rigid base and supporting assembly for the walking beam 16, which is in the form of an I-beam having a portion of the saddle bearing assembly 18 rigidly fixed to the under surface thereof for oscillation about a transverse axis, so that the horsehead 20 moves in an arcuate path with the arcuate outer surface of the horesehead 20 reciprocating the polish rod 24 in a vertical path in a well known manner.

A hydraulically operated piston and cylinder assembly 54 extends between the base or skid 12 and the walking beam 16. This assembly includes an upright pedestal 56 rigidly affixed centrally to a cross member 44 and extending upwardly therefrom and terminating in a plate 58 to which the lower end of an upright support 60 is attached by a similar plate 62 secured thereto with a transverse pivot bolt 64 connecting the plate 62 with the upright support 60. The pedestal 56 and support 60 forms a support for a cylinder 66 with the upper end of the support 60 including a plate 68 supportingly engaging a plate 70 on the lower end of the cylinder 66 with the plates 62 and 58 being rigidly secured together and the plates 68 and 70 being rigidly secured together by suitable bolts, or the like. A piston 71 within the cylinder 66 includes a piston rod 72 extending axially from the cylinder 66 and being connected to a lug 74 by a pivot bolt 76 parallel to the pivot bolt 64. The lug 74 is rigidly secured to the walking beam 16 by virtue of it being rigid with a bottom plate 78 engaging the under surface of the walking beam and being rigidly secured thereto by clamp bolts 80 which extend upwardly through a top clamp plate 82. Thus, the piston and cylinder assembly 54 extends between the beam 16 and the base or skid 12 with the pivot axes 64 and 76 enabling angular displacement of the piston and cylinder assembly during extension and retraction thereof so that the walking beam 16 may pivot about the transverse axis defined by the saddle bearing assembly 18. The structure of the support 60 may vary inasmuch as it may be adjustable in length, such as by using a pair of adjustable telescopic members in order to vary the vertical position of the supporting plates 68 thereby accommodating piston and cylinder assemblies having different over-all lengths, so that the stroke of the piston rod 72 may be varied by changing the piston and cylinder assembly 54. Also, by loosening the bolts 80, the point of connection between the piston rod 72 and the walking beam 16 may be adjusted toward and away from the transverse axis defined by the saddle bearing assembly thereby varying the stroke of the horsehead 20 without varying the stroke of the piston rod 72 which enables the full stroke of the piston and cylinder assembly to be utilized but enabling variation of the stroke of the horsehead 20.

Figure 3:
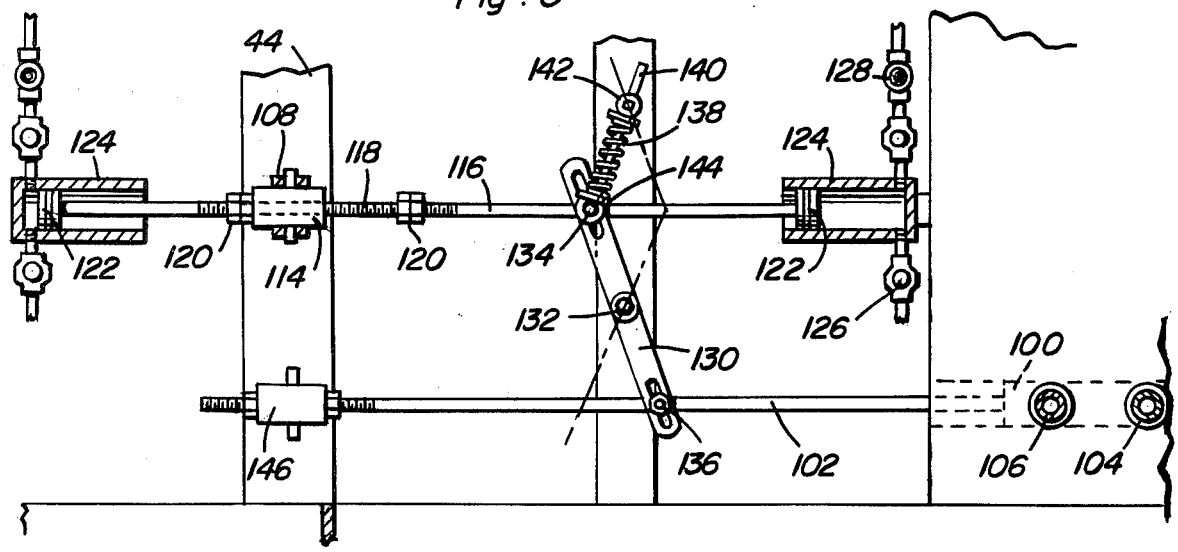
FIG. 3 is an enlarged plan view of the over center mechanism utilized for operating the pump reversing valve.
Figure 2:
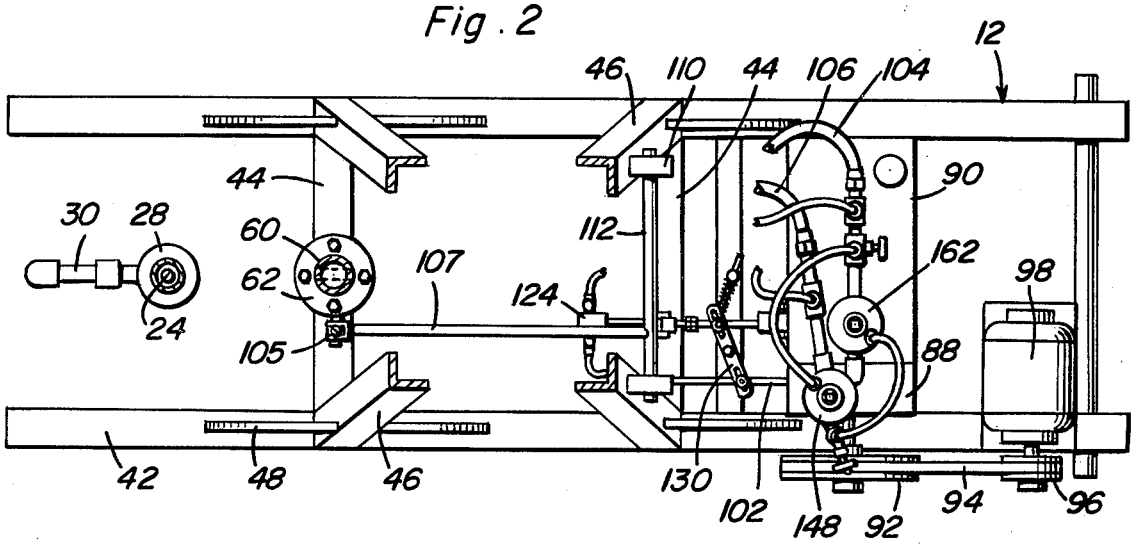
FIG. 2 is a plan view taken along section line 2—2 of FIG. 1 illustrating the structural association of the components of the invention.

The cylinder 66 is provided with a pair of conduits 84 and 86 communicated with the upper and lower ends thereof respectively and these conduits are supplied hydraulic fluid under pressure from a hydraulic pump 88 supported from the base or skid 12 alongside of a reservoir or tank 90. The pump 88 is a standard high pressure hydraulic pump and is driven from a V-belt pulley 92, or the like, encircled by a V-belt 94 engaged with a drive pulley 96 on the output shaft of a prime mover, such as a relatively small electric motor 98 with the power requirements of the hydraulically actuated pump jack being substantially less than conventional pump jacks inasmuch as a three horsepower electric motor or similar horsepower small internal combustion engine, or any other suitable power means may be provided for driving the pump 88. The pump 88 includes a reversing valve structure 100 operated by a rod 102 connected thereto so that when the rod 102 is reciprocated to extreme positions, the reversing valve 100 will reverse the discharge from the pump from discharge conduit 104 to discharge conduit 106. The reversing valve 100 is operated by an elongated lever connected with the walking beam 16 at the pivot bolt 76 so that the lever 105 moves in an arcuate path along with the beam 16. The lower end of the lever 105 is connected to a lever 107 which is rigid with a depending lever 108 which together form a bell crank pivotally supported by brackets 110 for oscillation about a generally horizontal axis 112, so that the bell crank defined by the levers 107 and 108 will pivot about a pivot axis 112 for swinging the lower end of the lever 108 in a fore and aft arcuate path. The lower end of the bell crank lever 108 is provided with a bifurcated, slotted connection with a yoke 114 mounted on an actuating rod 116 which parallels the reversing valve rod 112. The rod 116 includes a threaded portion 118 through the yoke 114 with adjustment nuts 120 being provided thereon to adjust the position of the yoke 114 on the rod 116 and to vary the lost motion connection between the yoke 114 and the rod 116. The actuating rod 116 includes a piston 122 on each end thereof received in a cylinder 124 which serves as a cushion device to reduce the speed of an over center snap action spring 138 and also a lubricating oil pump which has check valves 126 associated therewith and an adjustment needle valve 128. Oil discharged from the cylinder 124 by piston 122 is directed to lubricate the moving parts and needle valve 128 controls the speed of spring 138 and in turn controls the speed of reversing valve 100. The rod 116 is connected to the rod 102 by a fulcrum lever 130 pivotal about a vertical pivot point 132 adjacent its center and having a slotted pivot connection 134 at one end with the rod 116 and slotted pivot connection 136 at the other end to the rod 102 so that the reversing valve rod 102 will reciprocate in opposite relation to the rod 116. The over center spring 138 is mounted on a rod 140 slidable through a pivot post 142 with one end thereof abutting a plate 144 on the inner end of the rod 140 where it connected with the pivot point 134. As illustrated in FIG. 3, the rod 140 and the fulcrum lever 130 are disposed in angular relation with the spring 138 serving to bias the rod 116 to one of its limits of movement. As the yoke 114 moves toward the pivot point 134, the first motion will not move the rod 116 but when the yoke 114 engages the lock nuts or abutment 120. It will start to move the rod 116 and move the lever 130 and rod 140 into parallel aligned relation to each other while compressing the spring 138 when the rod 140 is pushed through the slide pivot 142. As soon as the pivot point 134 passes a center position, that is, past a position with the lever 130 and rod 140 in alignment, the spring 138 tending to expand will snap the rod 116 rapidly to its extreme forward position, as viewed in FIG. 3, which will cause corresponding rapid movement of the reversing valve rod 102, thereby rapidly moving the reversing valve 100 between its two positions. The lubricating mechanism operated by the pumps formed by the pistons 122 and cylinders 124 is not shown in detail but any suitable tubular arrangements may be provided for discharging lubricating material in desired locations so that the reversing mechanism will maintain proper operating conditions over a long period of time. The reversing valve rod 102 is provided with a yoke 146 thereon to which a manual handle may be connected to provide for manual reversing of the reverse valve 100 when desired.

Figure 4:
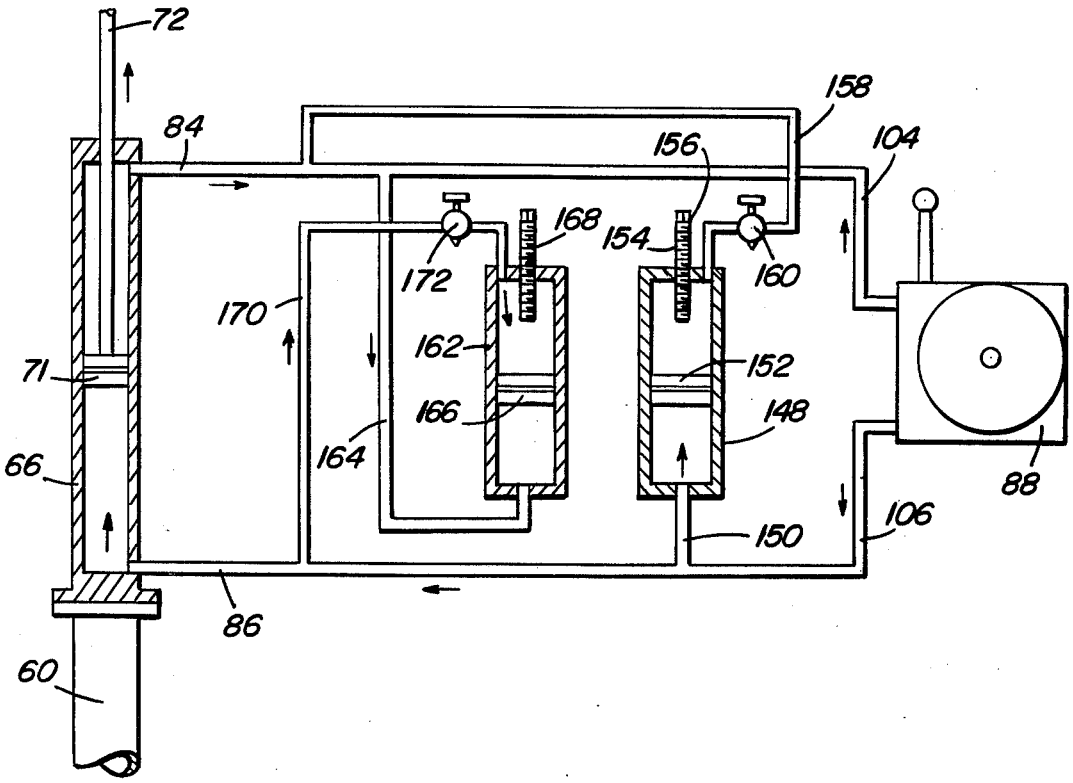
FIG. 4 is a schematic view of the crossover cushioning assembly.

As illustrated schematically in FIG. 4, the pump discharge line 106 which communicates with the bottom conduit 86 to the cylinder 66 is provided with a cushioning cylinder 148 communicated therewith through a branch line 150. A freely moving piston 152 is disposed in the cylinder 148 and a screw threaded adjustable abutment 154 is screw threaded through the top of the cylinder 148 and provided with a polygonal upper end 156 for receiving a wrench or similar tool. A tube or conduit 158 communicates the top portion of the cylinder 148 with the discharge line 104 from the pump 88 which communicates with the top conduit 84 to the cylinder 66. A needle adjustment valve 160 is provided in the tube 158. Correspondingly, the discharge tube 104 is communicated with the lower end of a cylinder 162 through a branch line 164 with the cylinder having a free piston 166 therein, and an adjustable abutment 168 in the upper end thereof and a tube or conduit 170 communicating with the conduit 106 through an adjustable needle valve 172. Thus, as the reversing valve is positioned so that high pressure fluid is pumped through conduit 106, into conduit 86 and into the bottom of the cylinder 66 for forcing the piston 71 upwardly, a portion of this high pressure fluid will pass through the branch line 150 into the lower end of the cylinder 148, thus causing upward movement of the piston 152. Hydraulic fluid in the cylinder 148 above the piston 152 will be pumped out through the needle valve 160, tube 158 and into the conduit 104 and 84 which raises the pressure in this line and thus reduces the acceleration rate of the piston 71 and piston rod 72 from its lowermost position. As the piston 71 moves upwardly, pressure in the conduit 84 and conduit 104 increases which will, in effect, return or force the cushioning fluid which has entered the bottom of the cylinder 148 back into the line 86, thus accelerating the piston 71 after it has started its movement away from its lowermost position. This, in effect, initially reduces the acceleration of the piston 71 and then, as the piston 71 moves away from its lowest point or bottom dead center, the piston will be accelerated at a greater rate thereby enabling the piston to move initially at a slow accelerating rate and then at a higher accelerating rate as it moves away from bottom dead center. Movement of the piston 71 downwardly from top dead center will be effected in exactly the same manner so that initial acceleration is reduced and after the piston has started on its down stroke, it will be accelerated to a higher rate. This arrangement provides a crossover cushioning arrangement so that acceleration of the piston from a momentarily still position to a predetermined velocity will be at a variable rate with the initial portion of the movement being at a relatively slow acceleration rate and the subsequent movement being at a higher acceleration rate.

The walking beam is provided with counterbalance weights 174 thereon on the opposite side of the pivot axis from the piston and cylinder assembly 54 with the counterbalance weights being removable and replaceable on mounting plates 176 which are secured adjustably in position by clamp bolts 178. The number and weight of the counterbalance weights may be varied depending upon the installation requirements of each pump jack. The upper plate 176 is provided with a transverse rod 180 to which is adjustably connected an operating piston rod 182 having a plurality of notches 184 in the lower edge thereof so that the counterbalance weights 174 can be longitudinally adjusted by expansion and contraction of the piston rod 182 in relation to a cylinder 186 which is pivotally attached to the top clamp plate 82 for the connecting structure between the piston and cylinder assembly 54 and the walking beam 16. Thus, by loosening the bolts 178, the counterbalance weights may be shifted longitudinally of the walking beam and reclamped in desired position. On the other hand, by loosening the bolts 80 while the clamp bolts 178 are secure, the point of attachment between the piston and cylinder assembly 54 and the walking beam 16 may be adjusted. Both of such adjustments may be manually made but with the piston and cylinder assembly 182 and 186 being connected to the hydraulic pump in a conventional manner with suitable control valves, the adjustment of the counterbalance weights and the point of attachment between the piston and cylinder assembly and the walking beam may become power operated. Thus, by varying the number of weights and varying the position of the weights as well as varying the point of connection between the piston and cylinder assembly 54 and the walking beam, the requirements of each installation may be easily complied with in order to provide optimum operating conditions for the pump jack. The reduction in the initial acceleration rate of the piston and cylinder assembly and correspondingly the horsehead, provides reduced forces being imparted to the pump components as well as the components of the pump jack thereby prolonging the expected life of all of the components and reducing operating and maintenance costs.

Figure 5:
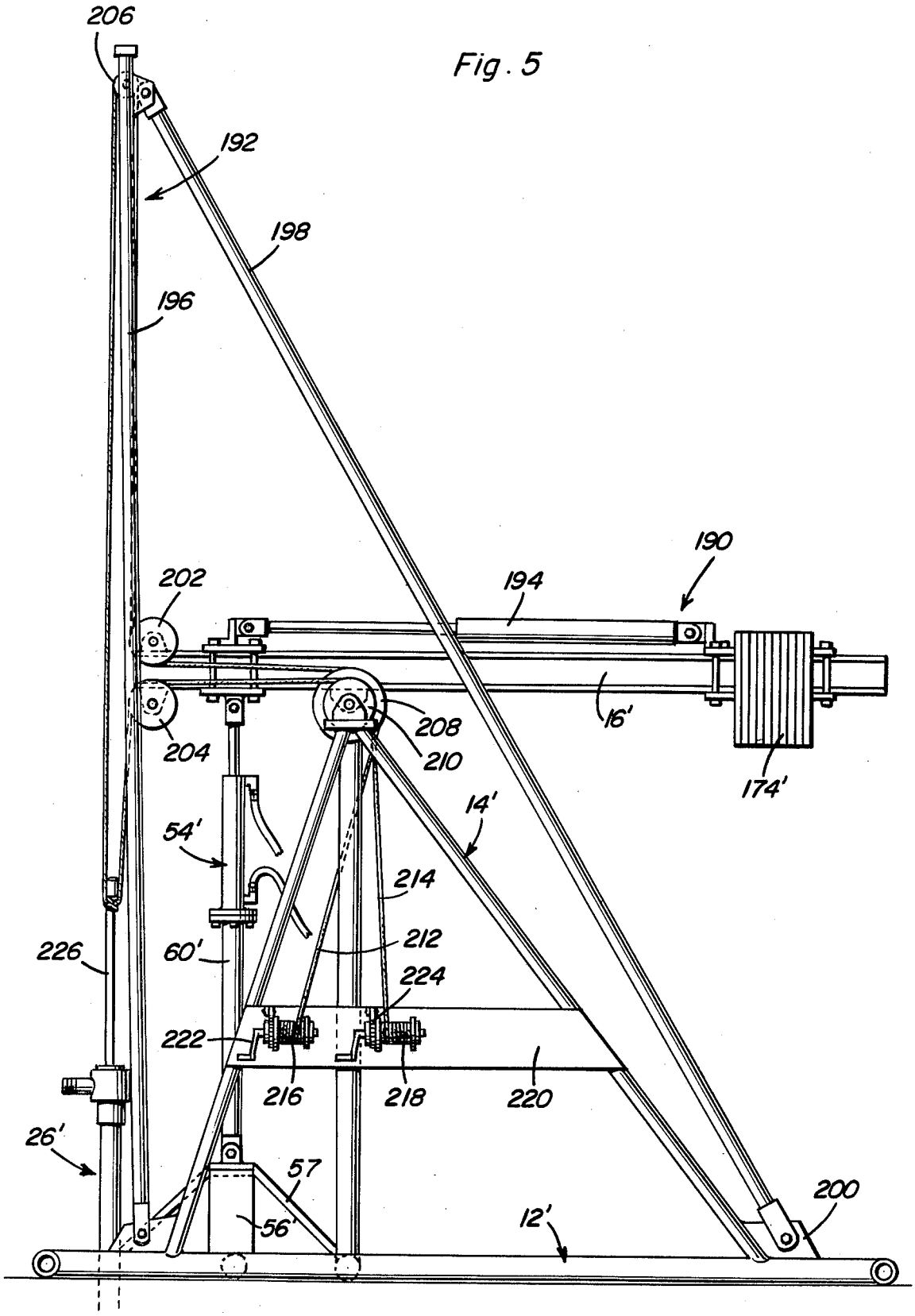
FIG. 5 is a side elevational view of the pump jack, illustrating a slightly different structural arrangement, with a gin pole assembly associated therewith for use in pulling polish rods, sucker rods, downhole pumps, production tubing, or the like, from the oil well or reassembling such components.

FIG. 5 illustrates schematically another embodiment of the pump jack in which certain of the components have been omitted for clarity, with this embodiment of the pump jack being designated by numeral 190 and being illustrated in association with a gin pole assembly generally designated by numeral 192 which enables the pump jack to be utilized when pulling a pump or production tubing from a well or when replacing the production tubing, pump, or the like. The pump jack 190 includes a skid or base 12' which may be of tubular pipe, or the like, and the stanchion or samson post 14' may also be of tubular members. In this arrangement, the adjusting piston and cylinder assembly for the counterbalance weights 174' and the point of attachment between the piston and cylinder assembly 54' and the walking beam 16' is designated by numeral 194 and is permanently connected between the top plates which support the counterbalance weights 174' and the point of attachment between the piston and cylinder assembly 54' and the walking beam 16'. Also, in this construction, the pedestal 56' is reinforced by inclined braces 57 but otherwise the structure remains substantially the same and operates in the same manner insofar as the pump, reversing valve, control thereof and crossover cushioning feature are concerned.

The gin pole assembly 192 includes a pair of upwardly converging gin poles 196 and a brace pole 198 which, in effect, provides a tripod-type of support with the lower ends of the poles 196 and 198 being connected to gussets 200 on the skid or base 12'. As illustrated, the pair of gin poles 196 and 198 are generally vertically disposed and are located generally in alignment with the end of the walking beam 16' having the horsehead connected thereto. When using the gin pole assembly 196, the horsehead is normally removed and a pair of pulleys 202 and 204 are mounted on the forward end of the walking beam 16' with the pulley 202 being above the walking beam 16' and pulley 204 being below. At the upper end of the pair of gin poles, a pulley 206 is mounted in alignment with the pulley 202. Also, on the upper end of the stanchion 14', pulleys 208 and 210 are journaled with the pulley 208 being in alignment with the pulley 202 and the pulley 210 being in alignment with the pulley 204. Cables 212 and 214 are entrained over the pulleys 208 and 210, respectively, and are wound on ratchet winches 216 and 218, respectively, mounted on a supporting member 220 secured to the stanchion 14' with the winches 216 and 218 being manually operated and provided with handles 222 for this purpose and also being provided with a manual ratchet mechanism 224. Assuming that it is desired to pull the downhole pump or production tubing from the well, the cables 212 and 214 are entrained over the pulleys in the manner illustrated and connected with a polish rod and subsequently one of the sucker rods 226. Assuming that the walking beam 16' is pivoted to a position so that the end thereof having the pulley 204 is at its lowermost position, the cable 212 is attached to the sucker rod 226 and the winch 218 actuated to remove all slack therefrom. Then, the piston and cylinder assembly 54' is expanded thus pivoting the walking beam 16' to move the pulley 204 upwardly which, due to the fixed length of the cable 214, will elevate the sucker rod 226 in relation to the well. After the pulley 204 reaches its uppermost position, the end of the cable 212 is attached to the sucker rod and all slack taken out of the cable 212 by actuating the winch 216. The piston assembly 54' is then contracted, thus moving the pulley 202 downwardly along with the pulley 204 which further elevates the sucker rod due to the fixed length of the cable 212 and provides slack in the cable 214 which is taken up by the ratchet winch 218. Thus, by alternatively connecting the cables 212 and 214 to the sucker rod 226, the sections of sucker rod may be elevated and disassembled or by reversing this procedure, the sucker rod sections may be assembled and lowered into the well. Thus, by using the gin pole assembly 192, the hydraulically operated pump jack can be used to pull the polish rod, sucker rods, downhole pump and production tubing, or any other tool, in the oil well or the procedure may be reversed for installing such equipment.

When the pump jack is used to pull pumps or tools, the automatic reversing mechanism is disconnected and the reversing valve on the pump is operated manually in order to properly control the movement of the walking beam. The gin poles and brace pole form an A-frame and are easily attached to the skid or base in any suitable manner. If desired, powered winches may be provided or other mechanism may be provided for taking up slack in the cables and enabling the cable to be paid out of the winch reel during operation of the pump jack as a lifting and lowering tool. The usual slips may be employed to assure that the sucker rod will be properly supported during operation of the pump jack during the lifting and lowering of the sucker rod. Also, the counterweights may be adjusted longitudinally in various ways, such as by using screw threaded turnbuckle type devices or other screw threaded devices or by using a hand operated winch or sprocket gear and chain assembly. Likewise, the point of connection between the piston and cylinder assembly and the walking beam may be easily adjusted by various means. Once the adjustments have been made for a particular installation, it is not usually necessary to readjust the components unless the operating conditions of the well are to be changed. For example, if a different pump is to be used having different stroke requirements, then it would be necessary to adjust the point of attachment of the piston and cylinder assembly with the walking beam.

While dimensional characteristics of the device may vary, the skid may conveniently be 15 feet in length and of a width to enable it to be easily transported on a truck bed, automobile trailer, or the like. The over-all length of the walking beam and horsehead may be conveniently 12 feet, with all of the components being rigidily secured together by using conventional techniques, such as welding, bolting, and the use of reinforcing gussets where deemed appropriate.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a pump jack for well pumps comprising a support, a beam mounted on said support for pivotal movement about a generally horizontal transverse axis, a horsehead at one end of said beam for connection with a polish rod of a well pump, a hydraulic fluid pressure operated piston and cylinder assembly connected to said beam for powering the beam about its pivot axis, a counterbalance weight on said beam on the opposite side of the transverse axis from the horsehead, said piston and cylinder assembly being powered from a hydraulic pump having a separate conduit connected to each end of the cylinder, a reversing valve communicating the pump with the conduits, and means interconnecting the reversing valve and the beam for controlling the position of the reversing valve in response to extension and retraction of the piston and cylinder assembly, said means controlling the reversing valve including a mechanical linkage, said linkage including adjustment means enabling variation in the stroke of the piston and cylinder assembly, each of said conduits including means cushioning high pressure hydraulic fluid moving from the reversing valve to the piston and cylinder assembly for cushioning movement of said beam, each of said cushioning means including a cylinder communicated at one end with said conduit, a piston movable in said cylinder in peripherally sealed relation thereto whereby said piston will move longitudinally in the cylinder in response to pressure changes in the conduits for cushioning movement of the hydraulic fluid in the conduits.

2. The structure as defined in claim 1 together with a tube extending from the end of one cylinder communicated with the conduit to the opposite end of the other cylinder, a tube extending from the end of said other cylinder communicated with the conduit to the opposite end of said one cylinder, and adjustable valve means in each of said tubes to control flow therethrough.

3. The structure as defined in claim 2 wherein said linkage connected with the reversing valve includes a spring biased overcenter linkage to snap the reversing valve to both of its positions.

4. The structure as defined in claim 3 wherein said overcenter linkage includes a pair of pivotally connected levers with aligned position of the levers being a center position, a pair of cushioning piston and cylinders dampening movement of the levers and pumping lubricant onto the pivotal connection between the levers.

5. The structure as defined in claim 1 together with means adjusting the point of connection of the piston and cylinder assembly with the beam longitudinally of the beam to vary the stroke of the horsehead without varying the stroke of the piston and cylinder assembly.

6. The structure as defined in claim 1 together with means longitudinally adjusting the counterbalance weight along the beam.

7. In combination, a pump jack for well pumps comprising a support, a beam mounted on said support for pivotal movement about a generally horizontal transverse axis, a horsehead at one end of said beam for connection with a polish rod of a well pump, a hydraulic fluid pressure operated piston and cylinder assembly connected to said beam for powering the beam about its pivot axis, a counterbalance weight on said beam on the opposite side of the transverse axis from the horsehead, and hydraulic power means longitudinally adjusting the counterbalance weight along the beam, said power means also serving to adjust the point of connection between the beam and the piston and cylinder assembly longitudinally of the beam.

8. The structure as defined in claim 1 wherein said support includes a base, a samson post extending upwardly from the base and supporting said beam, a pedestal on said base, an upwardly extending member connected to the base, said piston and cylinder assembly connected to the upper end of the upwardly extending member and extending upwardly therefrom.

9. In combination, a pump jack for well pumps comprising a support, a beam mounted on said support for pivotal movement about a generally horizontal transverse axis, a horsehead at one end of said beam for connection with a polish rod of a well pump, a hydraulic fluid pressure operated piston and cylinder assembly connected to said beam for powering the beam about its pivot axis, a counterbalance weight on said beam on the opposite side of the tranverse axis from the horsehead, and a gin pole attached to said support and extending alongside of the horsehead to a height substantially above the horsehead, lift cable means engaged with the beam and supported by the upper end of the gin pole and operative to pull the polish rod, sucker rods, pump, or production tubing from the oil well.

10. The combination of claim 9 wherein said lift cable means includes a pair of cables, a pair of ratchet winches on said support for winding said cables, said ratchet winches winding the cables alternately when slack occurs therein during oscillation of the beam.

11. In a pump jack for well pumps in which the jack includes a base with an upstanding support, a beam mounted on said support for pivotal movement about a generally horizontal transverse axis, means at one end portion of the beam for connection with a pump operating rod, counterbalance means connected with the beam, hydraulic fluid pressure operated piston and cylinder means connected to said beam for pivoting said beam and reciprocating said pump operating rod, reversing valve means communicating said piston and cylinder means with a source of pressurized hydraulic fluid through hydraulic fluid pressure conduits, and means controlling operation of said reversing valve in response to pivotal movement of said beam, that improvement comprising cushioning means in each hydraulic fluid pressure conduit for cushioning movement of said beam adjacent both extreme positions of the beam during its pivotal movement, each of said cushioning means including a cylinder and piston freely movable therein, each cylinder having one end communicating with one of said conduits and the opposite end communicating with the other of said conduits whereby increase in pressure in one of said conduits will cause an increase in pressure in the other conduit through movement of the piston.

12. The structure as defined in claim 11 together with flow restricting means between one end of each of said cylinders and one of said conduits.

* * * * *